United States Patent [19]

Sinclair

[11] Patent Number: 4,900,029

[45] Date of Patent: Feb. 13, 1990

[54] GOLF CLUB HEAD WITH AERODYNAMIC UPPER SURFACE

[76] Inventor: Hugh J. Sinclair, 30 Palmer Green, Baltimore, Md. 21210

[21] Appl. No.: 324,466

[22] Filed: Mar. 16, 1989

[51] Int. Cl.[4] ..... A63B 53/04

[52] U.S. Cl. ..... 273/167 E; 273/167 D; 273/169; D21/214

[58] Field of Search ..... 273/167–175, 273/77 R, 77 A; D21/214

[56] References Cited

U.S. PATENT DOCUMENTS

| | | | |
|---|---|---|---|
| D. 239,187 | 3/1976 | Smith | D21/214 |
| D. 240,748 | 7/1976 | Bock | D21/214 |
| 2,550,846 | 5/1951 | Milligan | 273/167 E |
| 3,997,170 | 12/1976 | Goldberg | 273/164 |
| 4,065,133 | 12/1977 | Gordos | 273/167 E |
| 4,828,265 | 5/1989 | Antonious | 273/167 E |

FOREIGN PATENT DOCUMENTS

| | | | |
|---|---|---|---|
| 8202669 | 8/1982 | PCT Int'l Appl. | 273/167 E |

*Primary Examiner*—Edward M. Coven
*Assistant Examiner*—Sebastiano Passaniti
*Attorney, Agent, or Firm*—N. J. Aquilino

[57] ABSTRACT

A golf club head having an aerodynamic upper surface including a vertical airfoil and a cavity therein. The cavity includes a first planar surface sloping downwardly and rearwardly from behind the ball striking face, and an upstanding rear wall which acts as the front portion of the airfoil. A normal swing of the club head positions the airfoil at substantially right angles to the swing path creating an aerodynamic effect on the air flow to reduce drag and increase clubhead speed.

4 Claims, 2 Drawing Sheets

GOLF CLUB HEAD WITH AERODYNAMIC UPPER SURFACE

BACKGROUND OF THE INVENTION

The present invention relates to golf clubs, and in particular to a wood-type golf club head having an aerodynamic upper surface.

More traditional golf club heads are being replaced by new shapes and materials in an effort to obtain maximum velocity of a golf ball being struck, and the distance that the ball flies in keeping within the accepted rules of golf. The use of aerodynamic shapes to enhance the above-mentioned qualities of the golf club head are well known in the prior art as shown in the design patents to Smith (U.S. Pat. No. Des. 239,187), Bizovi (U.S. Pat. No. Des. 240,058), Bock (U.S. Pat. No. Des. 240,748), and utility patents to Milligan (U.S. Pat. No. 2,550,866), Stuff (U.S. Pat. No. 4,431,192) and Antonious (U.S. Pat. No. 3,468,544).

The present invention is directed to a golf club head having an aerodynamic shaped upper surface in the form of a vertical airfoil extending upwardly at the rear of the club head and a deep well or cavity in the upper surface which slopes rearwardly from a point on the club head just behind the ball striking face toward the rear surface of the club head. The airfoil reacts with the air flow across the club head to reduce drag and increase the speed of the club head as it is swung.

In a first preferred embodiment, the cavity includes side walls formed by the toe and heel portion of the club head as the upper surface of the bottom of the well tapers downwardly toward the rear edge. In a second preferred embodiment, the well extends the entire width of the club head in the heel to toe direction so that no side walls are used. The inner rear wall of the cavity, which forms the front portion of the airfoil, extends in a vertical direction approximately parallel to the ball striking face. The depth of the cavity extends downwardly approximately two-thirds of the distance between the top and bottom surfaces of the club head at its deepest point adjacent the rear wall. The vertically extending airfoil portion of the club head as formed by the inside and outside rear wall surfaces is preferrably approximately one-half inch in width for a club head which is approximately two and one-half to three inches in length from the front ball striking face to the rear surface thereof. Therefore, the width of the vertical airfoil member is approximately twenty percent of the total distance from the front to rear of the club head.

Among the objects of the present invention are the provision of an improved aerodynamically shaped golf club head which reduces drag and increases club head speed, and the provision of a golf club head having a unique aerodynamic vertical airfoil to increase the efficiency and force used to strike a golf ball.

Other objects will become apparent in view of the drawings and specification.

DESCRIPTION OF PREFERRED EMBODIMENTS

Figure 6:
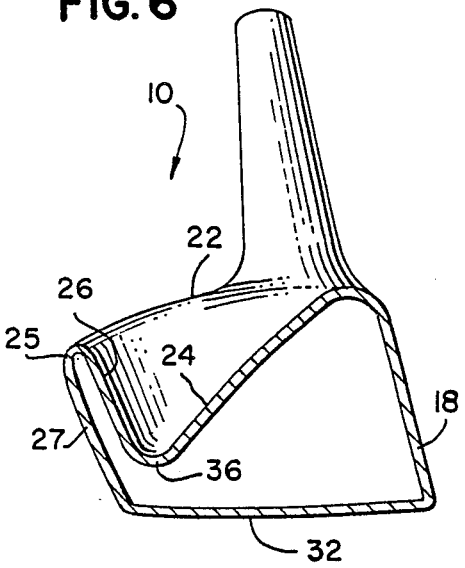
FIG. 6 is a sectional view taken along the lines 6—6 of FIG. 3.
Figure 7:
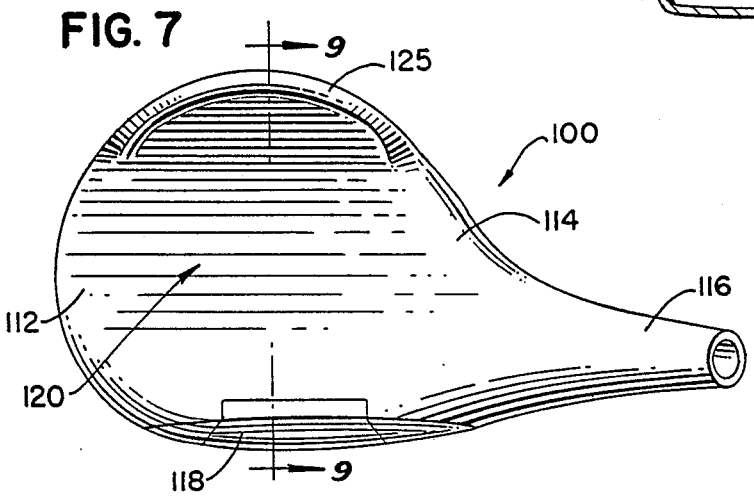
FIG. 7 is a top plan view of a second embodiment of the present invention.
Figure 8:
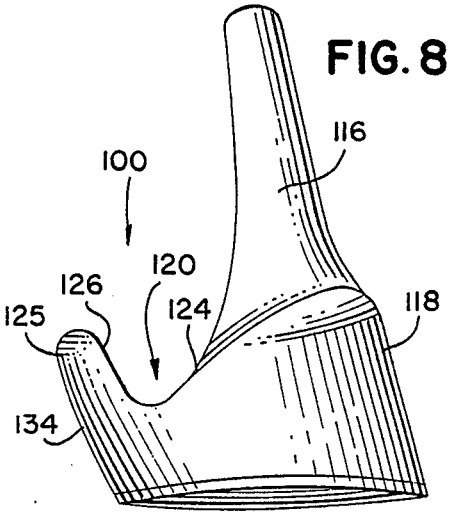
FIG. 8 is an end elevational view of FIG. 7.
Figure 9:
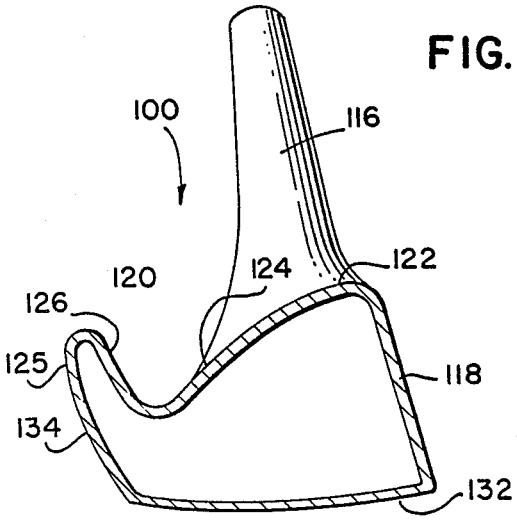
FIG. 9 is a side sectional view taken along the lines 9—9 of FIG. 7.

Referring to the drawings, FIGS. 1 to 6 show a first embodiment of the present invention, and FIGS. 7 to 9 show a second embodiment of the present invention.

Figure 1:
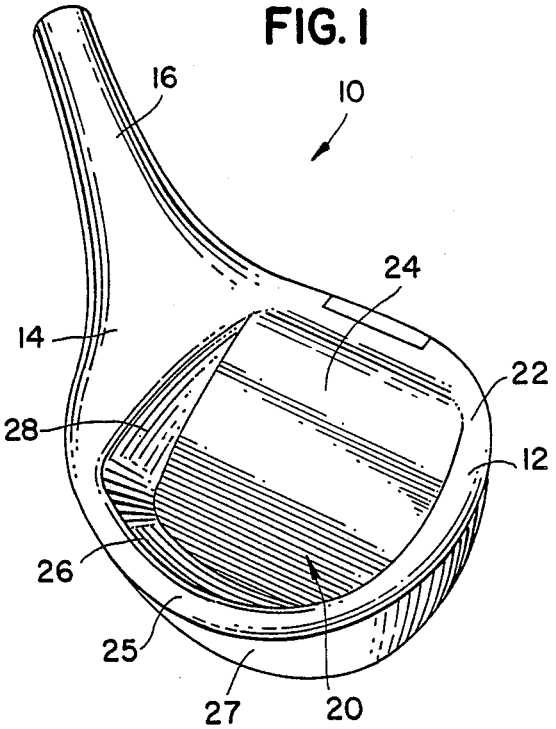
FIG. 1 is a perspective view of the golf club head of the present invention.

FIG. 1 illustrates a golf club head 10 of the present invention, which may be of the wood or metal wood type, including a toe 12, heel 14, and hosel 16 which is adapted to receive a conventional shaft and grip (not shown). The club head 10 is provided with a conventional ball striking face 18 which is used to strike a golf ball when the club head is properly swung. The top 22 of the club head 10 includes an aerodynamic surface formed by a vertical airfoil 25 having a front surface and a rear surface and a cavity 20 having a downwardly sloping surface 24 and an upstanding rear wall 26, which also forms the front surface of the airfoil 25. The rear surface 27 of the club head 10 forms the rear portion of the airfoil 25. The cavity 20 also includes side walls 28 and 30 at the heel 14 and toe 12 of the club head 10 respectively.

Figure 4:
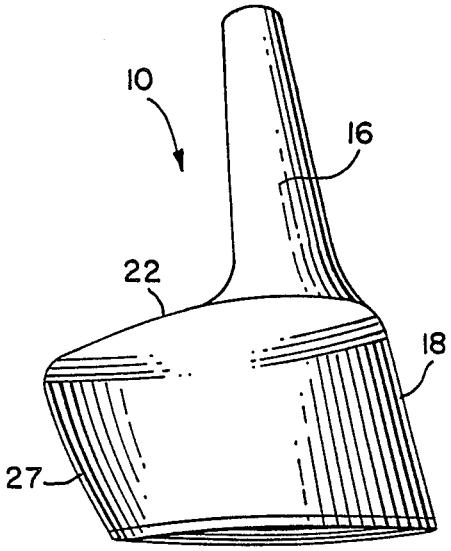
FIG. 4 is an end elevational view thereof.
Figure 2:
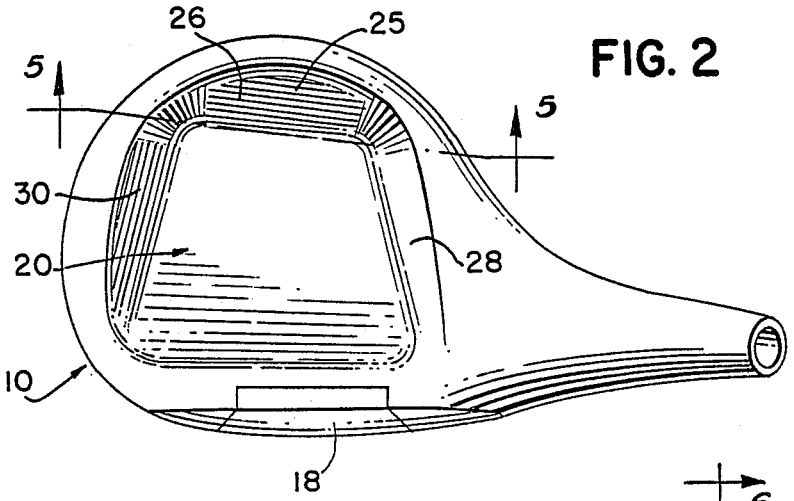
FIG. 2 is a top plan view thereof.
Figure 3:
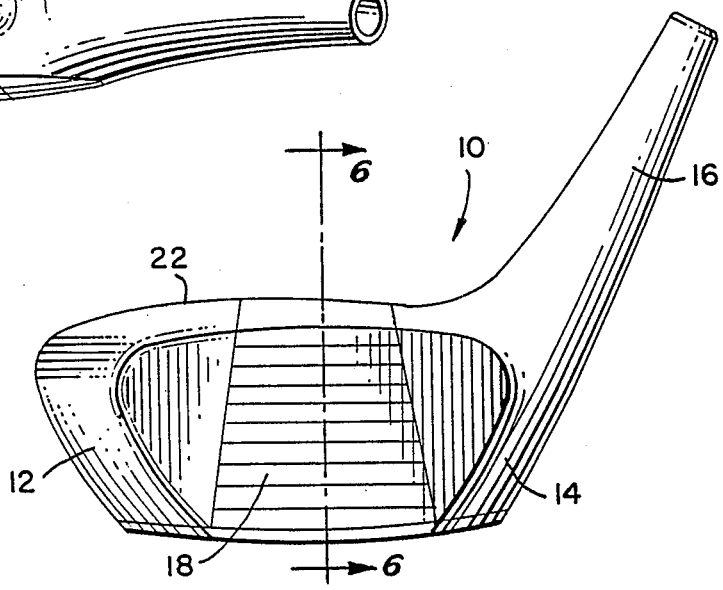
FIG. 3 is a front elevational view thereof.
Figure 5:
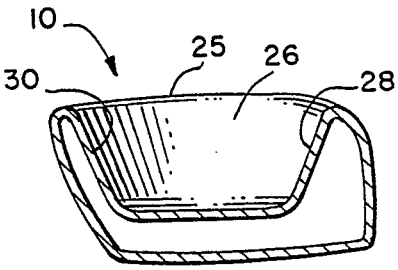
FIG. 5 is a sectional view taken along the lines 5—5 of FIG. 2.

As seen in FIGS. 3 and 4, the golf club head 10, when looked at in elevation from the front or either side are conventional in design and the airfoil 25 and cavity 20 are not seen. Referring particularly to FIG. 6, the aerodynamic cavity 20 slopes downwardly to a point at least one half and preferably approximately two-thirds of the way between the top surface 22 and the bottom 32 of the club head 10. As can be seen from the drawing the planar surface 24 and the rear wall 26 of the aerodynamic cavity 20 interface at a junction 36 and form an angle of approximately 70 degrees to each other. The rear wall 26 of the cavity 20, forming the front surface of the airfoil 25, is essentially parallel to the ball striking face 18 of the club head 10. Referring to FIG. 2, it can be seen that the cavity 20 extends almost the entire width of the club head 10 in the heel 14 to toe 12 direction.

A normal golf swing in arcuate and downward from the top of the backswing to the area where the ball is struck causing the club head to gain momentum and speed until the clubface makes contact with the ball. The aerodynamic cavity 20 and the vertical airfoil 25 of the present invention, which can be compared to the airfoils of an airplane, create lift and increase club head speed.

As the golf club is swung, air spills over the ball striking face 18 and across the top 22 of the club head 10, down into the aerodynamic cavity 20 following the tapering surface 24 until it strikes the rear wall 26 of the cavity 20, which forms the front of the airfoil 25, at approximately right angles to the air flow path when the club head follows a normal swing plane. The interaction of the air and the vertical airfoil 25 creates a turbulence at the rear surface 27 of the club head 10. This turbulence provides lift at the bottom of the golf swing, much like an airplane coming out of a power dive and also decreases the club head drag encountered with conventional shapes by creating a partial vacuum behind the club head. This decreased drag in turn allows the club to be swung at a higher speed for a given force input.

A second embodiment of the golf club 100 is illustrated in FIGS. 7, 8 and 9. The club head 100 includes the standard features of a toe 112, heel 114, hosel 116, ball striking face 118, top 122, bottom 132 and rear surface 134. The club head 100 also includes a vertical airfoil 125 and an aerodynamic cavity 120. The aerodynamic cavity 120 extends to the entire width of the club head 100 in the heel 114 to toe 112 direction and includes a downwardly tapering upper surface 124 which extends from just behind the ball striking face 118 to a point adjacent the lower edge of an upstanding rear wall 126 of the cavity which forms the front portion on the vertical airfoil 125. The airfoil 25 is essentially parallel to the ball striking face 118. In this embodiment the inner side walls are eliminated since the cavity 120 extends the entire width of the club head in the heel to toe direction as shown in the elevational views of FIGS. 8 and 9.

The aerodynamic cavity 120 extends downwardly at least one-half and preferably two-thirds of the distance between the top surface 122 and the bottom 132 of the club head 100. This embodiment creates the same type of aerodynamic effect as the embodiment described in FIGS. 1 to 6 hereinabove.

It will be appreciated that although the invention is shown with metal club heads, it is equally applicable to wood type club heads.

Other modifications and changes may be made and that the invention is not limited to the forms shown, but defined in the following claims.

I claim:

1. An aerodynamic golf club head for increasing club head speed for a given force when swinging the club head, said club head including a ball striking face, heel, toe, hosel, upper surface, bottom and rear surface wherein the improvement comprises:

a vertical airfoil having a front surface and a rear surface and formed below said upper surface of said club head, said airfoil being substantially parallel to said ball striking face; said airfoil being characterized by said front surface being an upwardly extending rear wall of a cavity formed in said upper surface of said club head; said cavity being further defined by a planar surface, sloping downwardly and rearwardly from adjacent to and behind said ball striking face toward said rear surface; said cavity extending substantially the entire width of the club head in the heel to toe direction; and, said front surface of said airfoil extending to a depth at least one-half of the distance between said upper surface and said bottom of said club head.

2. The club head of claim 1 further including side walls at the edges of said cavity adjacent said toe and said heel.

3. The golf club head of claim 1 wherein said cavity extends the entire width of the club head in the heel to toe direction.

4. The golf club head of claim 1 wherein said planar surface and said rear wall of said cavity interface at an angle of at least 70 degrees.

* * * * *